US009394909B2

(12) United States Patent
Eslinger

(10) Patent No.: US 9,394,909 B2
(45) Date of Patent: Jul. 19, 2016

(54) SUBMERSIBLE PUMP HOUSING WITH SEAL BLEED PORTS

(75) Inventor: David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 899 days.

(21) Appl. No.: 13/604,628

(22) Filed: Sep. 6, 2012

(65) Prior Publication Data

US 2014/0037434 A1 Feb. 6, 2014

Related U.S. Application Data

(60) Provisional application No. 61/678,101, filed on Aug. 1, 2012.

(51) Int. Cl.
*F04D 13/10* (2006.01)
*F04D 29/08* (2006.01)

(52) U.S. Cl.
CPC ..... *F04D 13/10* (2013.01); *F04D 29/086* (2013.01); *Y10T 29/49243* (2015.01)

(58) Field of Classification Search
CPC .. F04D 13/10; F04D 29/086; Y10T 29/49243
USPC ..... 415/168.2
See application file for complete search history.

(56) References Cited

U.S. PATENT DOCUMENTS 4,495,998 A * 1/1985 Pringle ..... 166/321
5,099,919 A * 3/1992 Schneider et al. ..... 166/188
7,665,975 B2 2/2010 Parmeter
7,980,311 B2 7/2011 Dowling
8,021,132 B2 9/2011 Green
8,221,092 B2 7/2012 Chilcoat
2009/0159262 A1* 6/2009 Gay et al. ..... 166/105
2010/0300702 A1* 12/2010 Andrews et al. ..... 166/373

FOREIGN PATENT DOCUMENTS

GB 2036134 11/1982

OTHER PUBLICATIONS

Combined search and examination report for the equivalent GB patent application No. 1313678.3 issued on Mar. 18, 2014.

* cited by examiner

*Primary Examiner* — Igor Kershteyn
*Assistant Examiner* — Aaron R Eastman
(74) *Attorney, Agent, or Firm* — Michael Stonebrook

(57) ABSTRACT

A submersible pump housing with seal bleed ports is provided. In an implementation, a pump housing for electric submersible pumps (ESPs), such as a centrifugal ESP, has end seals that are located inside or further inboard toward the high thrust pressure generated by the pump, than the threaded ends of the pump housing. The inboard seals contain and seal off the pump pressure and spare the threaded regions that are more pressure-vulnerable from the pump's high pressure interior, thereby increasing the pressure rating of the entire housing. Leak ports or bleed ports are provided further outboard of the end seals to relieve fluid seeping from inside the submersible pump housing past each end seal. A plate may be added to direct small amounts of fluid escaping from the end seals away from the wellbore casing in which an ESP is situated.

11 Claims, 4 Drawing Sheets

SUBMERSIBLE PUMP HOUSING WITH SEAL BLEED PORTS

RELATED APPLICATIONS

This patent application claims the benefit of priority to U.S. Provisional Patent No. 61/678,101 to Eslinger, filed Aug. 1, 2012 and entitled, "Submersible Pump Housing With Seal Bleed Holes," which is incorporated herein by reference in its entirety.

BACKGROUND

An electric submersible pump (ESP) is often used in well settings to artificially lift subsurface resources such as hydrocarbons and water to the Earth's surface. Conventionally, the maximum pressure rating of a given ESP housing is limited by the stresses in the threaded end portion of the ESP housing. In a conventional centrifugal pump housing (diffuser), for example, the housing is sealed at the head and at the base with an O-ring seal located at the end of the housing and outboard of the end threads. Conventional arrangement of the end seals in an ESP causes the circumferential or hoop stresses of the housing in the threaded region to be the sum of the hoop stresses due to the thread radial forces resulting from axial loads on the thread flank angle, and the internal pressure differential from inside to outside the housing. The sum of these hoop stresses determines the maximum pressure rating of a conventional housing. Some conventional ESP housings have end seals both inboard and outboard of the threaded ends of the conventional housings. However, there is no fluid path from inside to outside the housing between these two seals. Thus, this conventional arrangement can trap the high internal pressure between the two seals and render the conventional inboard seal ineffective.

SUMMARY

A submersible pump housing with seal bleed ports is described. In an implementation, the submersible pump housing includes a housing, an interior compartment of the housing for fluid at high thrust pressure, a threaded end region of the housing, an inboard end seal to seal off the threaded end region from the interior compartment; and at least one bleed hole or port outboard of the end seal for allowing leakage of fluid from the interior compartment past the end seal to escape radially through the housing. An example centrifugal pump housing may include a diffuser for directing high thrust fluid accelerated by an impeller, an end seal inboard of each threaded end of the centrifugal pump housing, and at least one leak port outboard of each end seal to relieve a fluid seeping from inside the centrifugal pump housing past each end seal. An example method includes locating an end seal inboard of a threaded portion of a centrifugal pump housing to seal internal pressure from the threaded portion, and locating a radial bleed port outboard of the end seal to relieve pressure of seepage past the end seal. This summary section is not intended to give a full description of submersible pump housings with seal bleed ports. A detailed description with example embodiments follows.

DETAILED DESCRIPTION

This disclosure describes submersible pump housings with seal bleed ports. Features, systems, and methods associated with submersible pump housings with seal bleed ports represent possible implementations and are included for illustration purposes and should not be construed as limiting. Moreover, it will be understood that different implementations can include all or different subsets of aspects described below. Furthermore, the aspects described below may be included in any order, and numbers and/or letters placed before various aspects are done for ease of reading and in no way imply an order, or level of importance to their associated aspects.

Figure 1:
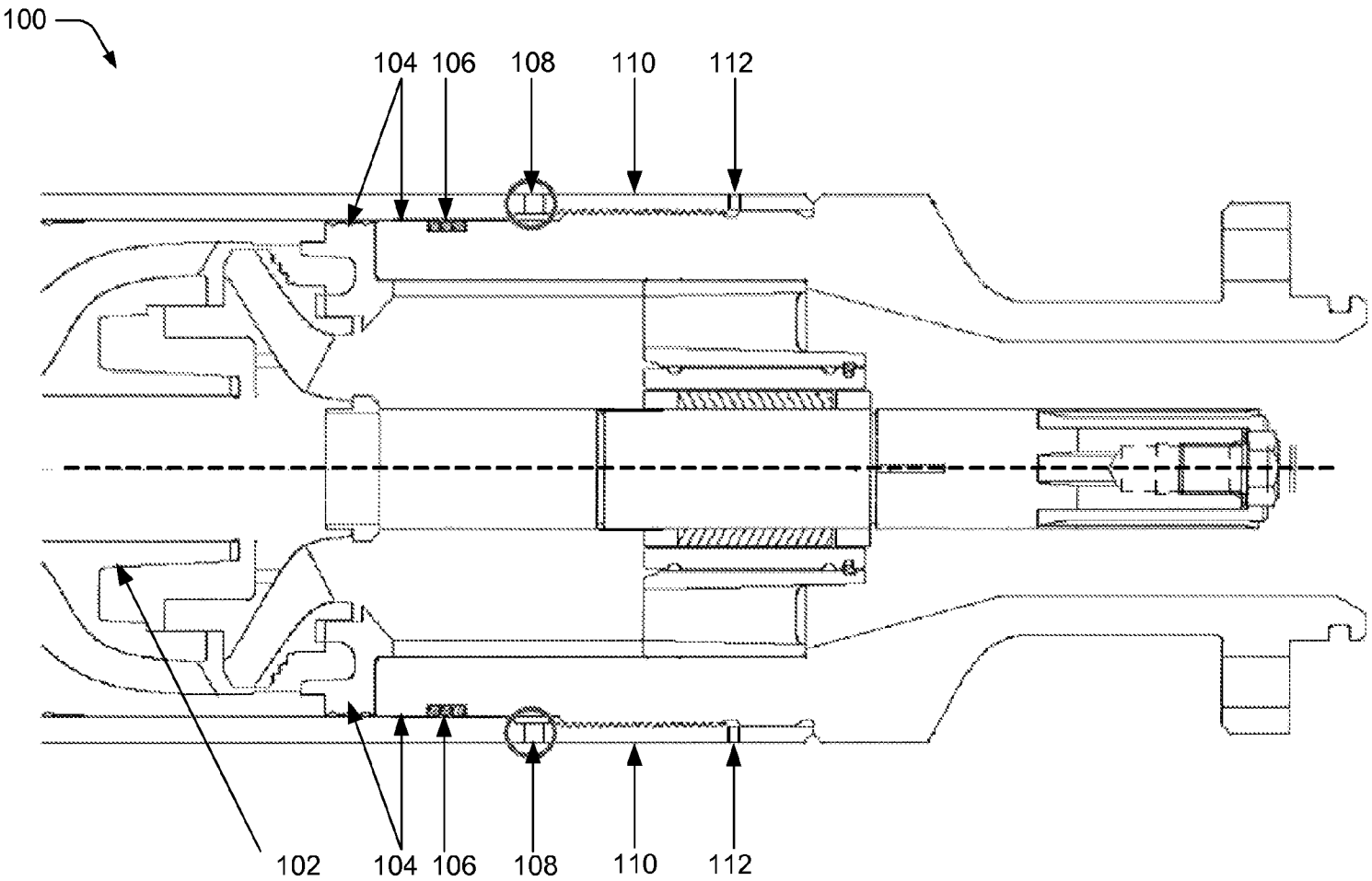
FIG. 1 is a diagram of an example electric submersible pump (ESP) section with inboard end seals and seal bleed ports.

FIG. 1 shows a section of an example electric submersible pump (ESP) 100 of the centrifugal type. The illustrated section shows a base-end portion of the centrifugal ESP 100. An impeller region 102 inside the pump housing generates high thrust pressure as the impeller accelerates fluid radially outward and axially upward, or toward a wellhead of an ESP installation. At the periphery of the pump housing, the fluid in the interior high pressure compartment 104 that includes the impeller region 102 extends to a location at which the end seal 106 is situated to seal off the high thrust pressure and highly mobilized fluid from flowing out to the exterior of the pump housing or from flowing out to the next component in a stack of components.

In the example centrifugal ESP 100 with seal bleed ports 108, the end seals 106 are inboard of the threaded end regions 110 of the pump housing in order to contain the high pressure compartment 104 and prevent the threaded end region 110 from participating in the interior high pressure compartment (s) of the ESP 100. This arrangement of having the end seals 106 inboard of the threads 110 increases the maximum pressure rating of the pump housing, because the threaded end regions 110 of conventional pumps are subject to increased stresses over the non-threaded regions of conventional pump housings when subjected to interior pump pressures. In FIG. 1, the bleed ports 108 or vent ports are located just outboard of the end seal 106 to provide a leak path for fluid that seeps or blows by the end seal 106. The terms "port" and "hole" as used herein, are used representatively to mean a fluid path, passageway, port, hole, lumen, channel, vent, etc., enabling the movement of fluid from one location to another. The vent ports do not have to be "holes," such as a round, straight passages as drilled by a bit. For example, the term bleed ports 108 can mean a vent passage that is a milled castellation(s) in the end face of either the housing or end cap (base or head).

In an implementation, the vent passage, leak path, or seal bleed ports 112 may be located outboard of the threaded end region 110, instead of just outboard of the end seal 106 as seal bleed ports 108 are. Locating the bleed ports 112 outboard of the threads 110 utilizes the threads 110 to dissipate leakage fluid pressure and minimize jetting velocity of fluid that has escaped the end seal 106.

The term "outboard" or "outboard of" as used herein, means "outside" or "on the other side of" a designated feature that is closer to, or more "inboard," to the pump's high thrust pressure compartments or to the fluids being accelerated by the pump. Correspondingly, "inboard," as used herein, means "inside of," in first contact with, or in closer contact with the high thrust pressure generated by the pump than a designated feature that is therefore more "outboard."

Figure 2:
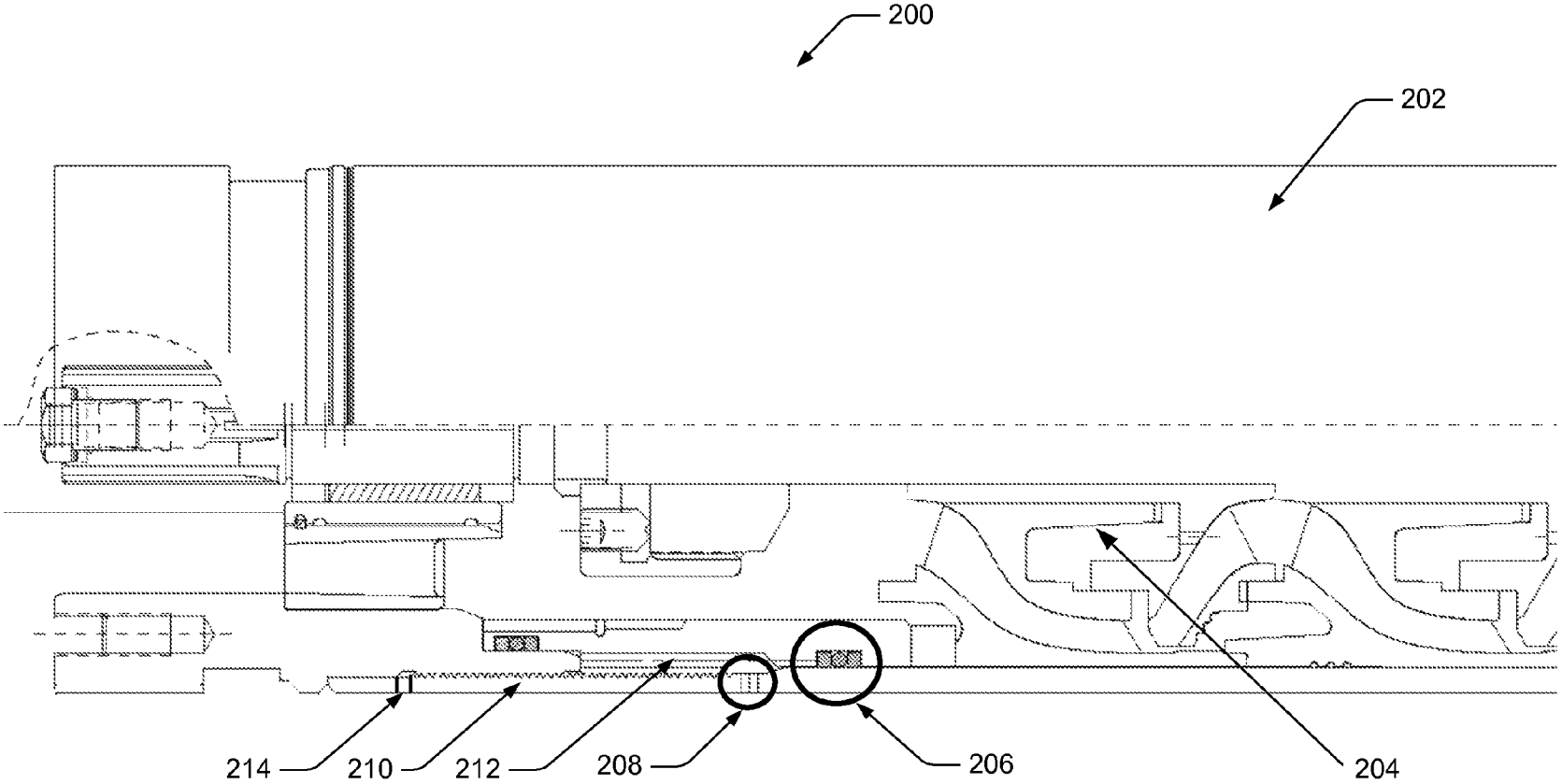
FIG. 2 is a diagram of a second example ESP section with inboard end seals and seal bleed ports.

FIG. 2 shows an example centrifugal ESP 200 with cutaway housing 202. The illustrated section shows a head-end portion of the example centrifugal ESP 200. The example centrifugal ESP 200 includes one or more impeller regions 204 in a high thrust pressure compartment. An end seal 206 is positioned inboard of one or more fluid bleed ports 208. The end seal 206 is also positioned inboard of a threaded end region 210. The illustrated bleed ports 208 are radially-directed to form a leak path from outboard of the end seal 206 to the exterior of the housing 202. In this manner, an internal pressure differential caused by the pumping action of the example centrifugal ESP 200 is sealed off from the end threads 210, and the hoop stresses in the same threaded region 210 are significantly reduced to enable a higher maximum pressure rating for the overall housing 202 of the example centrifugal ESP 200. Any fluid leakage that does seep past the end seal 206 on account of the high pressure that is inboard of the end seal 206 is allowed to escape the housing 202 without building up at the threaded region 210.

The bleed ports 208 form a leak path that is situated from inside to outside the housing 202 just outboard of the end seal 206. The leak path can be implemented so that a very small leakage of fluid past the end seal 206 does not pressure the space or volume that may exist between the end seal 206 and the contact face between the head (or the base) and the centrifugal pump housing 202. If this volume is pressured, then the same undesired stress state that exists in conventional housings occurs. In an implementation, the leak path can be created by drilling small radial holes in the housing 202 just downstream (outboard) of the end seal(s) 206. In an implementation, the seal bleed ports 214 may be located to form a leak path outboard of the threaded end region 210, instead of just outboard of the end seal 206 as seal bleed ports 208 are. Locating the bleed ports 214 outboard of the threads 210 utilizes the threads 210 to dissipate leakage fluid pressure and minimize jetting velocity of fluid that has escaped the end seal 206. The head-end of compression ring (CR) style pumps also requires a bleed path, such as port 212, for weepage that may occur past the compression ring-to-head seal.

Figure 3:
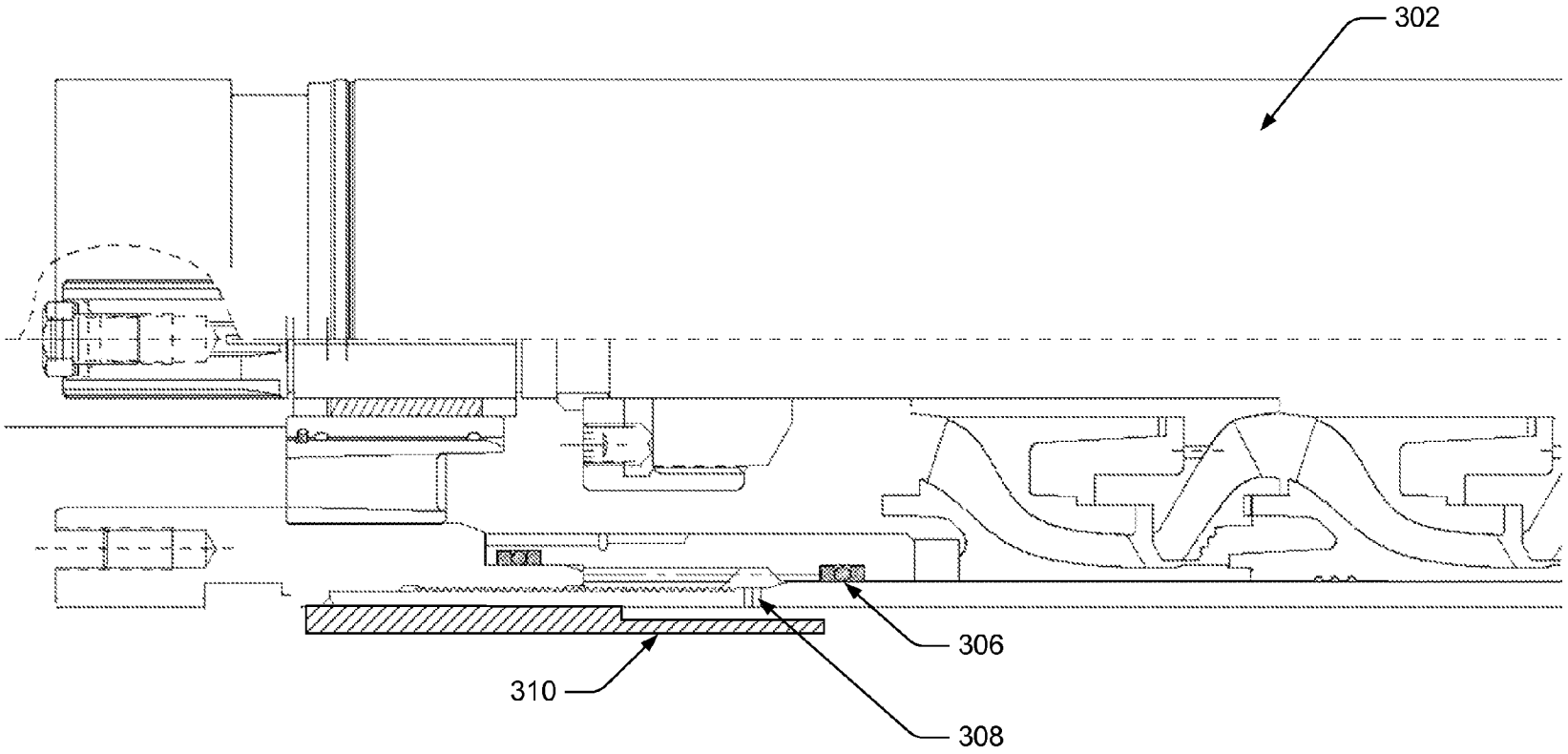
FIG. 3 is a diagram of an example ESP section with inboard end seals, seal bleed ports, and a lockplate protector.

FIG. 3 shows a centrifugal pump housing 302 with inboard seal 306, bleed port 308, and an example housing lockplate protector 310. The lockplate protector 310 covering the bleed port 308 shown in FIG. 3 can be used to protect the well casing from any damage due to fluid leaking from the radial bleed port 308 in the housing 302. The lockplate protector 310 can be a standard lockplate except that the housing-facing side of the lockplate can be stepped to allow bleed fluid to be deflected axially along the housing 302 rather radially toward the bore of the well casing.

In an implementation, an example submersible pump includes a housing, an interior compartment of the housing for fluid at high thrust pressure, a threaded end region of the housing, an inboard end seal to seal off the threaded end region from the interior compartment, and at least one bleed port or hole outboard of the end seal for allowing leakage of fluid from the interior compartment past the end seal to escape radially from the end seal through the housing.

The example submersible pump may comprise a centrifugal electric submersible pump (ESP) for the oil and gas industries. The housing may comprise a diffuser of the centrifugal ESP. The inboard end seal protects the threads to increase the pressure rating of the housing. The at least one bleed port can relieve a pressure between the end seal and a contact face between the submersible pump housing and a head or a base connecting to the submersible pump.

A lockplate protector over the bleed port can protect a well casing from the leakage of fluid from the interior compartment past the end seal. The lockplate protector can be stepped to deflect fluid axially along the housing instead of radially toward a bore of the well casing.

When the submersible pump is a compression ring (CR) style pump, a leak port can be used for weepage past a compression ring-to-head seal.

A centrifugal ESP may operate at temperatures of up to approximately 149 degree Celsius and pressures of up to approximately 6,000 pounds per square inch or approximately 41 megapascals in a downhole environment of up to approximately 12,000 feet or 3.7 kilometers deep. The centrifugal ESP can use up to approximately 1000 horsepower or 750 kilowatts of power and has a speed of rotation of a rotor of up to approximately 4000 revolutions per minute. Even in such harsh conditions, the end seal protects the threaded end region from the fluid at high thrust pressure in the interior compartment of the centrifugal ESP.

In an implementation, a centrifugal pump housing includes a diffuser for directing high thrust fluid accelerated by an impeller, an end seal inboard of each threaded end of the centrifugal pump housing, and at least one leak port outboard of each end seal to relieve a fluid seeping from inside the centrifugal pump housing past each end seal. Each leak port can relieve a pressure between a respective end seal and a contact face between the centrifugal pump housing and a head or a base.

A lockplate protector can be used over the leak port. The lockplate protector protects the well casing from a fluid leaking from the leak port. The lockplate protector can be stepped to deflect fluid axially along the centrifugal pump housing instead of allowing the fluid to escape radially toward a bore of the well casing.

Example Method

Figure 4:
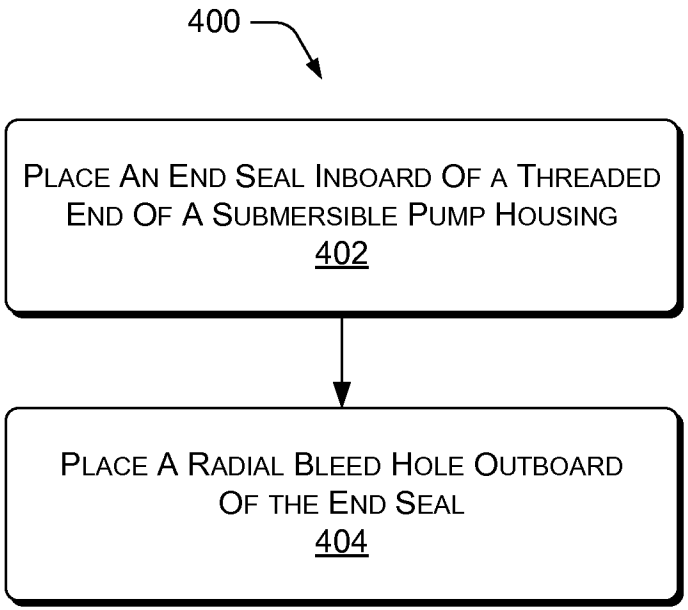
FIG. 4 is a flow diagram of an example method of increasing the pressure rating of a submersible pump housing.

FIG. 4 shows an example method 400 of increasing the pressure rating of a submersible pump housing. In an implementation, the submersible pump can be a centrifugal ESP. In the flow diagram, operations are shown in individual blocks.

At block 402, an end seal is located inboard of the threaded portion of a submersible pump housing to seal internal pressure from the threaded portion.

At block 404, radial bleed ports are located outboard of the end seal to relieve pressure of small blow-by or seepage past the end seal.

The example method enables an internal pressure differential of the submersible pump to be sealed from the end threads, and the hoop stresses in the threaded region of the housing to be significantly reduced, achieving a higher pressure rating for the example submersible pump housing.

CONCLUSION

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. A submersible pump, comprising:

a housing having a threaded end region threadably engaged with a component;

an interior compartment of the housing for fluid at high thrust pressure;

an inboard end seal positioned between the housing and the component inboard of the threaded end region to seal off the threaded end region from the interior compartment; and at least one vent passage extending to a region wherein the region is between the housing and the component, outboard of the end seal, and inboard of the threaded region for allowing leakage of fluid from the interior compartment past the end seal to escape through the housing.

2. The submersible pump of claim 1, wherein the submersible pump comprises a centrifugal electric submersible pump (ESP) for the oil and gas industries.

3. The submersible pump of claim 1, wherein the housing comprises a diffuser of a centrifugal ESP.

4. The submersible pump of claim 1, wherein the inboard end seal increases the pressure rating of the housing.

5. The submersible pump of claim 1, wherein the component comprises a head or a base and the at least one vent passage relieves a pressure between the end seal and a contact face between the submersible pump housing and the head or the base connecting to the submersible pump.

6. The submersible pump of claim 1, wherein the vent passage is configured to dissipate a leakage fluid pressure and to minimize a jetting velocity of the leakage of fluid that has escaped the inboard end seal.

7. The submersible pump of claim 1, wherein the vent passage comprises one of a fluid path, port, hole, lumen, channel, vent, passageway, or milled castellation(s) in an end face of either the housing, a base end cap, or a head end cap enabling a movement of the fluid from one location to another location.

8. The submersible pump of claim 1, further comprising a lockplate protector over the vent passage to protect a well casing from the leakage of fluid from the interior compartment past the end seal.

9. The submersible pump of claim 8, wherein the lockplate protector is stepped to deflect fluid axially along the housing instead of radially toward a bore of the well casing.

10. The submersible pump of claim 1, wherein the submersible pump comprises a compression ring (CR) style pump; and further comprising a leak port for weepage past a compression ring-to-head seal.

11. The submersible pump of claim 1, wherein the submersible pump comprises a centrifugal ESP capable of operating at a temperature of up to 149 degree Celsius and a pressure of up to 6,000 pounds per square inch in a downhole environment of up to 12,000 feet deep;

wherein the centrifugal ESP uses up to 1000 horsepower and has a speed of rotation of a rotor of up to 4000 revolutions per minute; and wherein the end seal protects the threaded end region from the fluid at high thrust pressure in the interior compartment.

* * * * *